US010176758B2

(12) United States Patent
Nie

(10) Patent No.: US 10,176,758 B2
(45) Date of Patent: Jan. 8, 2019

(54) AMOLED PIXEL DRIVER CIRCUIT AND PIXEL DRIVING METHOD

(71) Applicant: Shenzhen China Star Optoelectronics Technology Co., Ltd., Shenzhen (CN)

(72) Inventor: Chenglei Nie, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 48 days.

(21) Appl. No.: 15/328,891

(22) PCT Filed: Dec. 20, 2016

(86) PCT No.: PCT/CN2016/110902
§ 371 (c)(1),
(2) Date: Jan. 24, 2017

(87) PCT Pub. No.: WO2018/068392
PCT Pub. Date: Apr. 19, 2018

(65) Prior Publication Data

US 2018/0211600 A1 Jul. 26, 2018

(30) Foreign Application Priority Data

Oct. 14, 2016 (CN) ..... 2016 1 0900950

(51) Int. Cl.
*G09G 3/3258* (2016.01)
*G09G 3/3266* (2016.01)
*G09G 3/3225* (2016.01)

(52) U.S. Cl.
CPC ..... *G09G 3/3258* (2013.01); *G09G 3/3225* (2013.01); *G09G 3/3266* (2013.01); *G09G 2310/08* (2013.01); *G09G 2320/0233* (2013.01)

(58) Field of Classification Search
None
See application file for complete search history.

(56) References Cited

U.S. PATENT DOCUMENTS 9,478,169 B2 * 10/2016 Lim ..... G09G 3/3258
2006/0119548 A1 * 6/2006 Lan ..... G09G 3/3233 345/76
2015/0022244 A1 * 1/2015 Lee ..... G09G 3/006 327/108

* cited by examiner

*Primary Examiner* — Kenneth B Lee, Jr.
(74) *Attorney, Agent, or Firm* — Leong C. Lei

(57) ABSTRACT

The invention provides an AMOLED pixel driver circuit and pixel driving method. The AMOLED pixel driver circuit has a 6T2C structure, comprising a first thin film transistor (TFT) (T1), a second TFT (T2) forming mirror relation with the first TFT (T1), a third TFT (T3), a fourth TFT (T4), a fifth TFT (T5), a sixth TFT (T6), a first capacitor (C1), a second capacitor (C2) and an organic light-emitting diode (OLED) (D1), and receiving a first scan signal (Scant), a second scan signal (Scan2), a third scan signal (Scan3), a data signal (Data), and a predefined voltage (Vpre). The circuit can effectively compensate the threshold voltages of the driving TFT and the OLED, simplify the data signal, stabilize the current flowing through the OLED to ensure uniform light-emission of the OLED and improve display quality.

10 Claims, 5 Drawing Sheets

AMOLED PIXEL DRIVER CIRCUIT AND PIXEL DRIVING METHOD

BACKGROUND OF THE INVENTION

1. Field of the Invention

The present invention relates to the field of display techniques, and in particular to an AMOLED pixel driver circuit and pixel driving method.

2. The Related Arts

The organic light emitting diode (OLED) display provides the advantages of active light-emitting, low driving voltage, high emission efficiency, quick response time, high resolution and contrast, near 180° viewing angle, wide operation temperature range, and capability to realize flexible display and large-area full-color display, and is regarded as the most promising display technology.

The driving types of OLED can be divided, according to the driving method, into the passive matrix OLED (PMOLED) and active matrix OLED (AMOLED), i.e., the direct addressable type and thin film transistor (TFT) addressable type, wherein the AMOLED provides the advantages of pixels arranged in an array, self-luminous, and high luminous efficiency and is commonly used for high definition large-size display.

AMOLED is a current-driven device that emits light when a current flows through the OLED, and the light-emitting luminance is determined by the current flowing through the OLED. Most of the known integrated circuits (ICs) only transmit voltage signals, so the AMOLED pixel driver circuit needs to complete the task of converting the voltage signal into a current signal.

The known AMOLED pixel driver circuit is usually 2T1C structure, that is, two thin film transistors (TFTs) and a capacitor, to convert voltage to current; wherein one TFT is a switching TFT for controlling the entrance and exit of the data signal, and the other TFT is a driving TFT, for controlling the current flowing through the OLED. Therefore, the importance of the threshold voltage of the driving TFT is obvious. The positive or negative drift of the threshold voltage will cause different amount of current flowing through the OLED even with the same data signal. However, the known TFTs made of low-temperature polysilicon (LTPS) or oxide semiconductors are subject to threshold voltage drift due to light, source-drain voltage stress and other factors. In the known 2T1C structure circuit, the threshold voltage drift of the driving TFT cannot be improved by adjustment. Therefore, the influence of the threshold voltage drift needs to be relieved by introducing new TFTs or new signals so that the AMOLD pixel driver circuit has a compensation function.

Some of the known technologies use the single-gate TFT as the driving TFT in the AMOLED pixel driver circuit. By detecting the threshold voltage of the driving TFT, and then adjusting the data signal value of the required input according to the drift extent of the threshold voltage. The shortcoming of this type of circuit is that the threshold voltage of the known single-gate TFT is usually increased by drifting towards positive due to stresses, such as, voltage and lights. Therefore, the data signal should be increased accordingly to alleviate the influence of the threshold voltage drift. As the increase in the data signal further enhances the voltage stress on the driving TFT, which accelerates the threshold voltage drift, a vicious cycle is formed as a result.

SUMMARY OF THE INVENTION

The object of the present invention is to provide an AMOLED pixel driver circuit, able to effectively compensate the threshold voltage drift of the driving TFT and the OLED, to simplify the data signal, to stabilize the current flowing through the OLED and to ensure even light-emitting of the OLED to improve display result.

Another object of the present invention is to provide an AMOLED pixel driving method, able to effectively compensate the threshold voltage change of the driving TFT and the OLED to solve the problem of unstable current flowing through the OLED caused by the threshold voltage drift so as to ensure uniform light-emitting of the OLED to improve display result.

To achieve the above object, the present invention provides an AMOLED driver circuit, which comprises: a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground.

According to a preferred embodiment of the present invention, the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

According to a preferred embodiment of the present invention, the first scan signal, the second scan signal and the third scan signal are all provided by an external timing controller.

According to a preferred embodiment of the present invention, the predefined voltage is a constant voltage.

According to a preferred embodiment of the present invention, the first scan signal, the second scan signal, and the third scan signal are combined to correspond to, in sequence, a pre-charging phase, a threshold voltage programming design phase and a driving light-emitting phase;

in the pre-charging phase, the first scan signal provides low level voltage, the second scan signal and the third scan signal provide high level voltage;

in the threshold voltage programming design phase, the first scan signal and the third scan signal provide low level voltage, the second scan signal provides high level voltage;

in the driving light-emitting phase, the first scan signal and the third scan signal provide high level voltage, the second scan signal provides low level voltage.

Another embodiment of the present invention provides an AMOLED pixel driving method, which comprises:

Step 1: providing an AMOLED pixel driver circuit, comprising:

a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground;

Step 2: entering a pre-charging phase:

the first scan signal providing high level voltage to cut off the fourth TFT; the second scan signal providing low level voltage to turn on the second TFT, the third TFT and the fifth TFT; the third scan signal providing high level voltage to turn on the sixth TFT; the power supply voltage being written into the drain and the top gate of the first TFT; the predefined voltage being written into the first node (i.e., the bottom gate of the first TFT); and the voltage provided by the data signal being written into the fourth node, the first capacitor being charged, with the voltage difference between the two ends being Vdata−Vpre, wherein Vdata is the voltage provided by the data signal and Vpre being the predefined voltage;

Step 3: entering a threshold voltage programming design phase:

the first scan signal remaining low level voltage to cut off the fourth TFT; the second scan signal remaining high level voltage to turn on the second TFT, the third TFT and the fifth TFT; the third scan signal providing low level voltage to cut off the sixth TFT; the first TFT being turned on, the voltages of the drain and the top gate of the first TFT continuously dropping as the time passing, and the threshold voltage of the first TFT continuously rising as the time passing, the threshold voltages of the first TFT stopping changing when the threshold voltage of the first TFT reaching Vth=Vpre−Vs, wherein Vth being the threshold voltage of the first TFT, Vs being the source voltage of the first TFT, at this point, the voltage of the top gate of the first TFT being stored in the second capacitor;

Step 4: entering a driving light-emitting phase:

the first scan signal providing high level voltage to turn on the fourth TFT; the second scan signal providing low level voltage to cut off the second TFT, the third TFT and the fifth TFT; the third scan signal providing high level voltage to turn on the sixth TFT; the voltage of the top gate of the first TFT remaining unchanged due to the storage of the second capacitor, and the threshold voltage of the first TFT remaining Vth=Vpre−Vs; the predefined voltage being written into the fourth node; the voltage of the first node (i.e., the bottom gate of the first TFT) becoming 2 Vpre−Vdata, the first TFT turned on, the OLED emitting light, and the current flowing through the OLED being independent of the threshold voltage of the first TFT.

According to a preferred embodiment of the present invention, the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

According to a preferred embodiment of the present invention, the first scan signal, the second scan signal and the third scan signal are all provided by an external timing controller.

According to a preferred embodiment of the present invention, the predefined voltage is a constant voltage.

Yet another embodiment of the present invention provides an AMOLED driver circuit, which comprises: a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground;

wherein the first TFT, the second TFT, the third TFT, the fourth TFT, the fifth TFT and the sixth TFT being all low temperature polysilicon (LTPS) TFTs, oxide semiconductor TFTs or amorphous silicon (a-Si) TFTs;

wherein the first scan signal, the second scan signal and the third scan signal being all provided by an external timing controller.

Compared to the known techniques, the present invention provides the following advantages. The present invention provides an AMOLED pixel driver circuit and pixel driving method, using double-gate TFT as the driving TFT. In the pre-charging phase, the power supply voltage is written into the drain and the top gate of the first TFT (i.e., the driving TFT) and the top gate of the second TFT, the predefined voltage is written into the bottom gate of the first TFT and one end of the first capacitor, and the voltage provided by the data signal is written into the other end of the first capacitor. In the threshold voltage programming design phase, the voltage of the top gate of the first TFT drops and the threshold voltage rises until the threshold voltages reaches Vth=Vpre−Vs. In the driving light-emitting phase, the second capacitor keeps the top gate voltage of the first TFT unchanged and the threshold voltage remains Vth=Vpre−Vs, the bottom gate voltage of the first TFT becomes 2 Vpre−Vdata; the first TFT is turned on, the OLED emits light and the current flowing through the OLED is independent of the threshold voltage of the first TFT and the threshold of the OLED, to effectively compensate the threshold voltage of the driving TFT and the OLED, simplify the data signal, ensure uniform light-emitting of the OLED, and improve display result.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
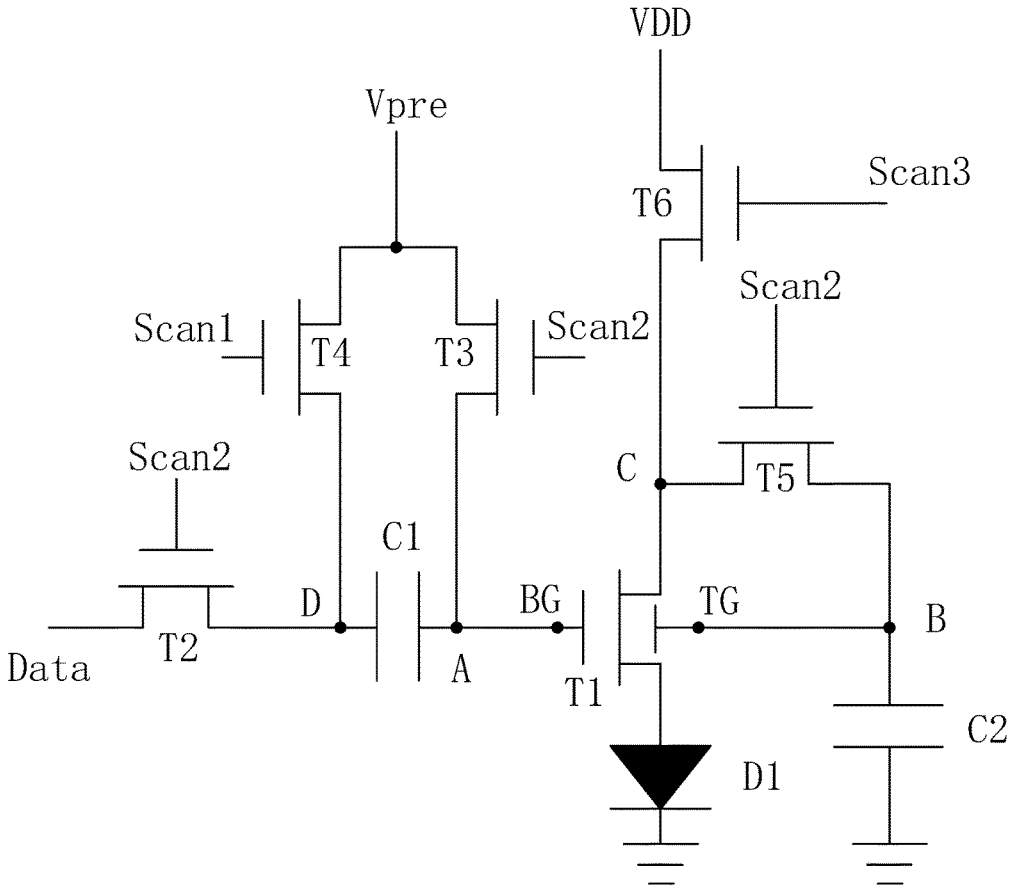
FIG. 1 is a schematic view showing a pixel driver circuit for AMOLED provided by the first embodiment of the present invention.
Figure 2:
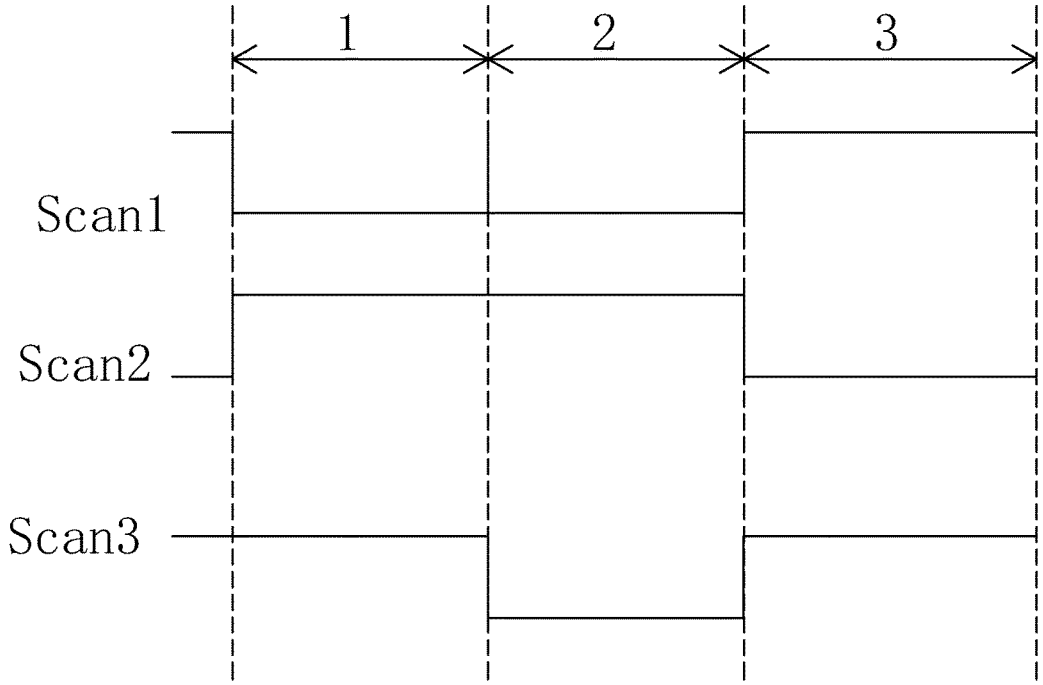
FIG. 2 is a schematic view showing the timing sequence of the pixel driver circuit for AMOLED provided by the first embodiment of the present invention.

Referring to FIG. 1 and FIG. 2, the present invention provides an AMOLED pixel driver circuit of 6T1C structure, which comprises: a first thin film transistor (TFT) T1, a second TFT T2, a third TFT T3, a fourth TFT T4, a fifth TFT T5, a sixth TFT T6, a first capacitor C1, a second capacitor C2, and an organic light-emitting diode (OLED) D1.

The first TFT T1 is a double-gate TFT, and has the bottom gate BG connected to a first node A and the top gate TG connected to a second node B, the source connected to anode of the OLED D1 and the drain connected to a third node C. The double-gate first TFT T1 is a driving TFT for driving the OLED D1. Based on the known research, the double-gate TFT shows the characteristics that the stresses of voltage and light have less influence on the threshold voltage, and also that the threshold voltage and the top gate voltage show a negative correlation relation. In other words, the higher the top gate voltage, the smaller the threshold voltage.

The second TFT T2 has the gate connected to receive a second scan signal Scan2, the source connected to received a data signal Data, the drain connected to a fourth node D.

The third TFT T3 has the gate connected to the second scan signal Scan2, the source connected to received a predefined voltage Vpre and the drain connected to the first node A.

The fourth TFT T4 has the gate connected to received a first scan signal Scan1, the source connected to the predefined voltage Vpre and the drain connected to the fourth node D.

The fifth TFT T5 has the gate connected to the second scan signal Scan2, the source connected to the second node B and the drain connected to the third node C.

The sixth TFT T6 the gate connected to received a third scan signal Scan3, the source connected to the power supply voltage VDD and the drain connected to the third node C.

The first capacitor C1 has one end connected to the first node A and the other end connected to the fourth node D.

The second capacitor C2 has one end connected to the second node B and the other end connected to the ground.

The OLED D1 has the anode connected to the source of the first TFT T1 and the cathode connected to ground.

Specifically, the first TFT t1, the second TFT T2, the third TFT T3, the fourth TFT T4, the fifth TFT T5 and the sixth TFT T6 are all low temperature polysilicon (LTPS) TFTs, oxide semiconductor TFTs or amorphous silicon (a-Si) TFTs.

Specifically, the first scan signal Scan1, the second scan signal Scan2 and the third scan signal Scan3 are all provided by an external timing controller.

Specifically, the predefined voltage Vpre is a constant voltage.

Specifically, referring to FIG. 2, the first scan signal Scan1, the second scan signal Scan2, and the third scan signal Scan3 are combined to correspond to, in sequence, a pre-charging phase 1, a threshold voltage programming design phase 2 and a driving light-emitting phase 3. In the pre-charging phase 1, the first scan signal Scan1 provides low level voltage, the second scan signal Scan and, the third scan signal Scan3 provide high level voltage. In the threshold voltage programming design phase 2, the first scan signal Scan1 and the third scan signal Scan3 provide low level voltage, and the second scan signal Scan2 provides high level voltage. In the driving light-emitting phase 3, the first scan signal Scan1 and the third scan signal Scan3 provide high voltage, and the second scan signal Scan2 provides low level voltage.

Furthermore, referring to FIGS. 3-5, in combination with FIGS. 1-2, the operation of the process of the AMOLED pixel driver circuit of the present invention is as follows:

In the pre-charging phase 1: the first scan signal Scan1 provides low level voltage to cut off the fourth TFT T4; the second scan signal Scan2 provides high level voltage to turn on the second TFT T2, the third TFT T3 and the fifth TFT T5; the third scan signal Scan3 provides high level voltage to turn on the sixth TFT T6; the power supply voltage VDD is written into the second node B and the third node C (i.e., top gate TG and the drain of the first TFT T1); the predefined voltage Vpre is written into the first node A (i.e., the bottom gate BG of the first TFT T1 and one end of the first capacitor C1); and the voltage provided by the data signal Data is written into the other end of the first capacitor C1. At this point, the first capacitor C1 is charged, and the voltage difference between the two ends is Vdata−Vpre, wherein Vdata is the voltage provided by the data signal Data.

In the threshold voltage programming design phase 2: the first scan signal Scan1 remains low level voltage to cut off the fourth TFT T4; the second scan signal Scan2 remains high level voltage to turn on the second TFT T2, the third TFT T3 and the fifth TFT T5; the third scan signal Scan3 provides low level voltage to cut off the sixth TFT T6; the first TFT T1 is turned on, the voltages of the drain and the top gate TG of the first TFT T1 (i.e., the second node B and the third node C) continuously drops and the threshold voltage of the first TFT T1 continuously rises as the time passing and first capacitor C1 discharges, the threshold voltages of the first TFT T1 stops changing when the threshold voltage of the first TFT T1 reaches Vth=Vpre−Vs, wherein Vth is the threshold voltage of the first TFT T1, Vs isg the source voltage of the first TFT T1, at this point, the voltage of the top gate TG of the first TFT T1 stored in the second capacitor C2.

In the driving light-emitting phase 3: the first scan signal Scan3 provides high level voltage to turn on the fourth TFT T4; the second scan signal Scan2 provides low level voltage to cut off the second TFT T2, the third TFT T3 and the fifth TFT T5; the third scan signal Scan3 provides high level voltage to turn on the sixth TFT T6; the voltage of the top gate TG of the first TFT T1 (i.e., the second node B) remains unchanged due to the storage of the second capacitor C2, and the threshold voltage of the first TFT T1 remains Vth=Vpre−Vs; the predefined voltage Vpre is written into the fourth node D; the voltage of the first node A (i.e., the bottom gate BG of the first TFT T1) becomes 2 Vpre−Vdata, the first TFT T1 is turned on, and the OLED emits light.

Furthermore, the equation to compute the current flowing through the OLED is:

$$\begin{aligned} I &= \beta(V_{BG}-Vth-V_S)^2 \\ &= \beta(2Vpre-Vdata-Vpre+Vs-Vs)^2 \\ &= \beta(Vpre-Vdata)^2 \end{aligned}$$

Wherein β is a constant coefficient related to the TFT characteristics.

As shown, the current flowing through the OLED D1 is independent of the threshold voltage of the first TFT T1, also independent of the threshold voltage of the OLED D1, and is only related to the voltage of the input data signal Data. The compensation of the threshold voltage drift of the driving TFT and compensation of the threshold voltage of the OLED caused by ageing also solves the problem of unstable current flowing through the OLED caused by the threshold voltage drift so as to ensure uniform light-emitting of the OLED to improve display result.

Figure 3:
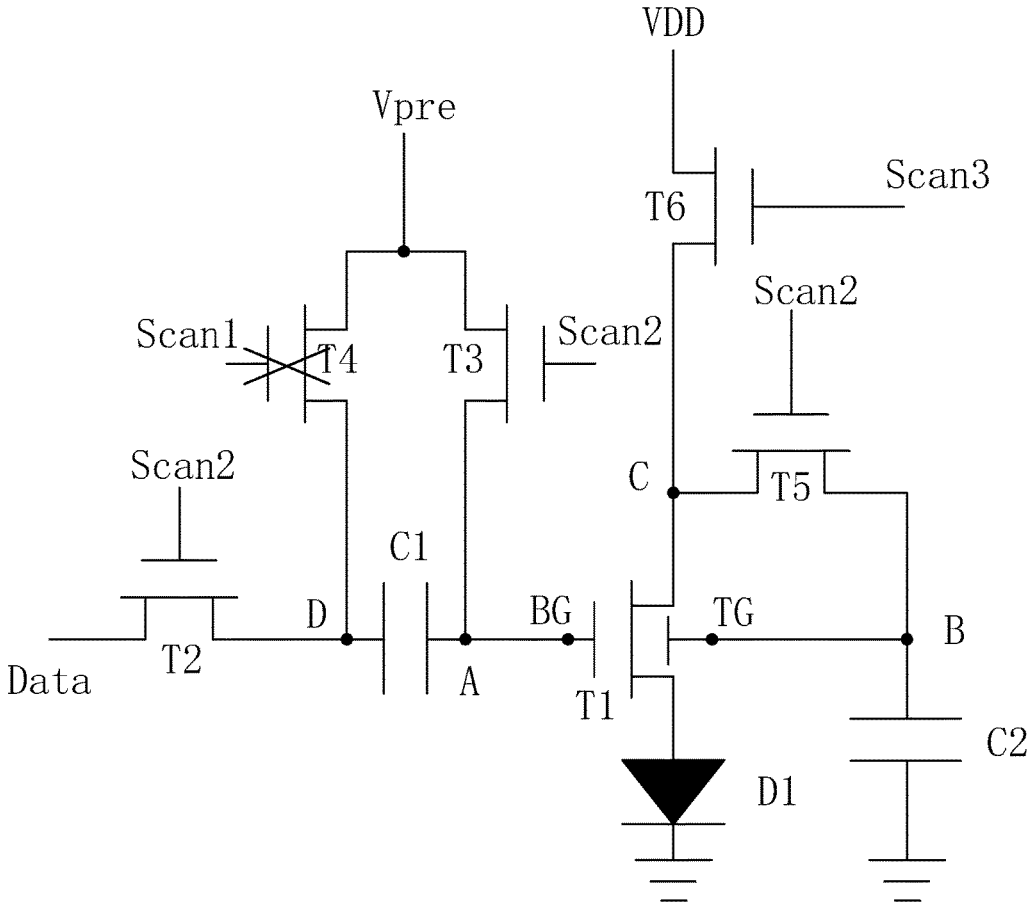
FIG. 3 is a schematic view showing Step 2 of the AMOLED pixel driving method provided by an second embodiment of the present invention.
Figure 4:
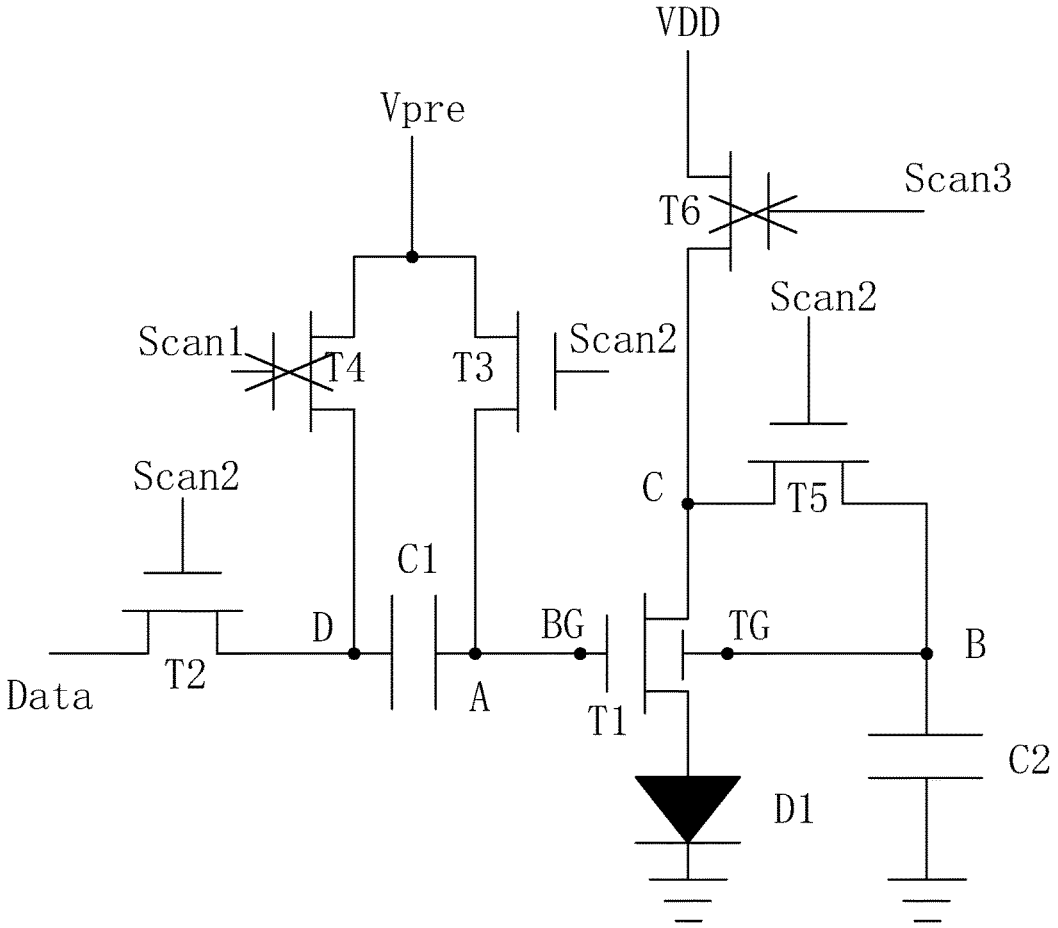
FIG. 4 is a schematic view showing Step 3 of the AMOLED pixel driving method provided by an second embodiment of the present invention.
Figure 5:
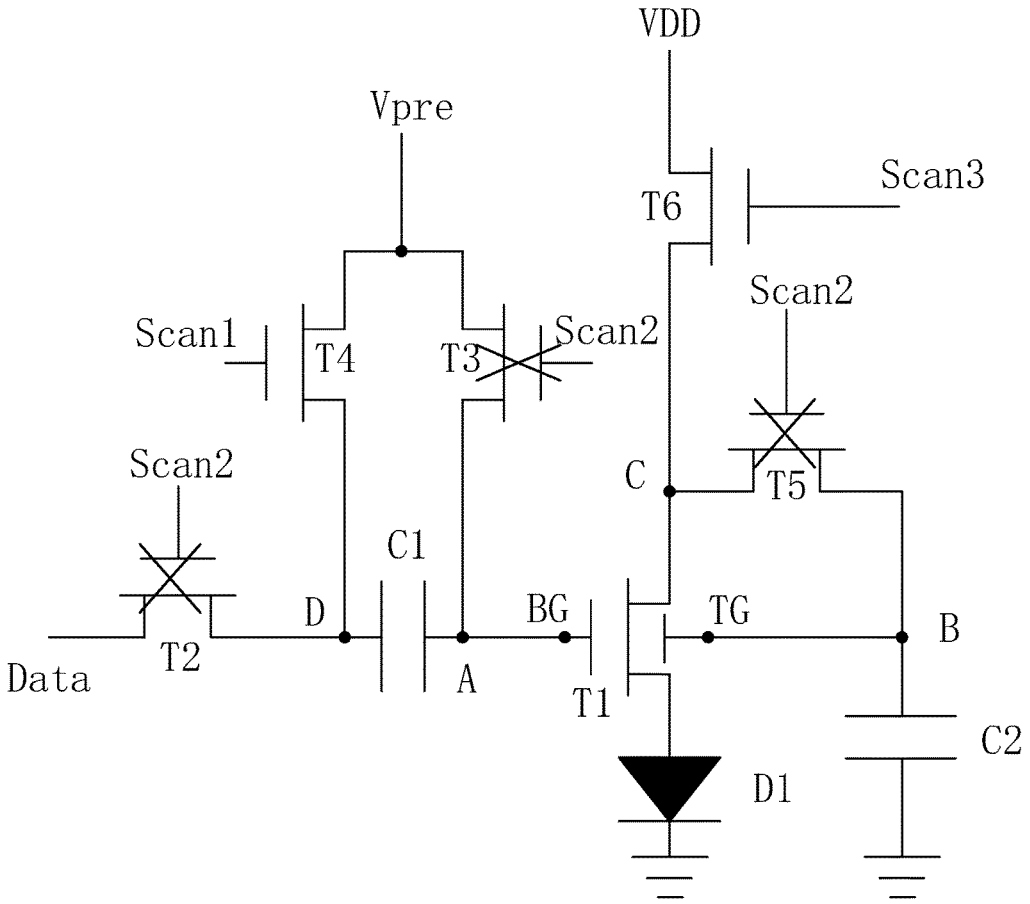
FIG. 5 is a schematic view showing Step 4 of the AMOLED pixel driving method provided by an second embodiment of the present invention.

Refer to FIGS. 3-5, in combination with FIGS. 1-2. Based on the aforementioned AMOLED pixel driver circuit, the present invention also provides an AMOLED pixel driving method, which comprises the following steps:

Step 1: providing an AMOLED pixel driver circuit.

The AMOLED pixel driver circuit comprises: a first thin film transistor (TFT) T1, a second TFT T2, a third TFT T3, a fourth TFT T4, a fifth TFT T5, a sixth TFT T6, a first capacitor C1, a second capacitor C2, and an organic light-emitting diode (OLED) D1.

The first TFT T1 is a double-gate TFT, and has the bottom gate BG connected to a first node A and the top gate TG connected to a second node B, the source connected to anode of the OLED D1 and the drain connected to a third node C. The double-gate first TFT T1 is a driving TFT for driving the OLED D1. Based on the known research, the double-gate TFT shows the characteristics that the stresses of voltage and light have less influence on the threshold voltage, and also that the threshold voltage and the top gate voltage show a negative correlation relation. In other words, the higher the top gate voltage, the smaller the threshold voltage.

The second TFT T2 has the gate connected to receive a second scan signal Scan2, the source connected to received a data signal Data, the drain connected to a fourth node D.

The third TFT T3 has the gate connected to the second scan signal Scan2, the source connected to received a predefined voltage Vpre and the drain connected to the first node A.

The fourth TFT T4 has the gate connected to received a first scan signal Scan1, the source connected to the predefined voltage Vpre and the drain connected to the fourth node D.

The fifth TFT T5 has the gate connected to the second scan signal Scan2, the source connected to the second node B and the drain connected to the third node C.

The sixth TFT T6 the gate connected to received a third scan signal Scan3, the source connected to the power supply voltage VDD and the drain connected to the third node C.

The first capacitor C1 has one end connected to the first node A and the other end connected to the fourth node D.

The second capacitor C2 has one end connected to the second node B and the other end connected to the ground.

The OLED D1 has the anode connected to the source of the first TFT T1 and the cathode connected to ground.

Specifically, the first TFT T1, the second TFT T2, the third TFT T3, the fourth TFT T4, the fifth TFT T5 and the sixth TFT T6 are all low temperature polysilicon (LTPS) TFTs, oxide semiconductor TFTs or amorphous silicon (a-Si) TFTs.

Specifically, the first scan signal Scan1, the second scan signal Scan2 and the third scan signal Scan3 are all provided by an external timing controller.

Specifically, the predefined voltage Vpre is a constant voltage.

Step 2: entering pre-charging phase 1.

The first scan signal Scan1 provides low level voltage to cut off the fourth TFT T4; the second scan signal Scan2 provides high level voltage to turn on the second TFT T2, the third TFT T3 and the fifth TFT T5; the third scan signal Scan3 provides high level voltage to turn on the sixth TFT T6; the power supply voltage VDD is written into the second node B and the third node C (i.e., top gate TG and the drain of the first TFT T1); the predefined voltage Vpre is written into the first node A (i.e., the bottom gate BG of the first TFT T1 and one end of the first capacitor C1); and the voltage provided by the data signal Data is written into the other end of the first capacitor C1. At this point, the first capacitor C1 is charged, and the voltage difference between the two ends is Vdata−Vpre, wherein Vdata is the voltage provided by the data signal Data.

Step 3: entering threshold voltage programming design phase 2.

The first scan signal Scan1 remains low level voltage to cut off the fourth TFT T4; the second scan signal Scan2 remains high level voltage to turn on the second TFT T2, the third TFT T3 and the fifth TFT T5; the third scan signal Scan3 provides low level voltage to cut off the sixth TFT T6; the first TFT T1 is turned on, the voltages of the drain and the top gate TG of the first TFT T1 (i.e., the second node B and the third node C) continuously drops and the threshold voltage of the first TFT T1 continuously rises as the time passing and first capacitor C1 discharges, the threshold voltages of the first TFT T1 stops changing when the threshold voltage of the first TFT T1 reaches Vth=Vpre−Vs, wherein Vth is the threshold voltage of the first TFT T1, Vs isg the source voltage of the first TFT T1, at this point, the voltage of the top gate TG of the first TFT T1 stored in the second capacitor C2.

Step 4: entering driving light-emitting phase 3.

The first scan signal Scan3 provides high level voltage to turn on the fourth TFT T4; the second scan signal Scan2 provides low level voltage to cut off the second TFT T2, the third TFT T3 and the fifth TFT T5; the third scan signal Scan3 provides high level voltage to turn on the sixth TFT T6; the voltage of the top gate TG of the first TFT T1 (i.e., the second node B) remains unchanged due to the storage of the second capacitor C2, and the threshold voltage of the first TFT T1 remains Vth=Vpre−Vs; the predefined voltage Vpre is written into the fourth node D; the voltage of the first node A (i.e., the bottom gate BG of the first TFT T1) becomes 2 Vpre−Vdata, the first TFT T1 is turned on, and the OLED emits light.

Furthermore, the equation to compute the current flowing through the OLED is:

$$\begin{aligned} I &= \beta(V_{BG}-Vth-V_S)^2 \\ &= \beta(2Vpre-Vdata-Vpre+Vs-Vs)^2 \\ &= \beta(Vpre-Vdata)^2 \end{aligned}$$

Wherein β is a constant coefficient related to the TFT characteristics.

As shown, the current flowing through the OLED D1 is independent of the threshold voltage of the first TFT T1, also independent of the threshold voltage of the OLED D1, and is only related to the voltage of the input data signal Data. The compensation of the threshold voltage drift of the driving TFT and compensation of the threshold voltage of the OLED caused by ageing also solves the problem of unstable current flowing through the OLED caused by the threshold voltage drift so as to ensure uniform light-emitting of the OLED to improve display result.

In summary, the present invention provides an AMOLED pixel driver circuit and pixel driving method, using double-gate TFT as the driving TFT. In the pre-charging phase, the power supply voltage is written into the drain and the top gate of the first TFT (i.e., the driving TFT) and the top gate of the second TFT, the predefined voltage is written into the bottom gate of the first TFT and one end of the first capacitor, and the voltage provided by the data signal is written into the other end of the first capacitor. In the threshold voltage programming design phase, the voltage of the top gate of the first TFT drops and the threshold voltage rises until the threshold voltages reaches Vth=Vpre−Vs. In the driving light-emitting phase, the second capacitor keeps the top gate voltage of the first TFT unchanged and the threshold voltage remains Vth=Vpre−Vs, the bottom gate voltage of the first TFT becomes 2 Vpre−Vdata; the first TFT is turned on, the OLED emits light and the current flowing through the OLED is independent of the threshold voltage of the first TFT and the threshold of the OLED, to effectively compensate the threshold voltage of the driving TFT and the OLED, simplify the data signal, ensure uniform light-emitting of the OLED, and improve display result.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An active matrix organic light-emitting diode (AMOLED) pixel driver circuit, which comprises: a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground;

wherein the first scan signal, the second scan signal, and the third scan signal are combined to correspond to, in sequence, a pre-charging phase, a threshold voltage programming design phase and a driving light-emitting phase;

in the pre-charging phase, the first scan signal provides low level voltage, the second scan signal and the third scan signal provide high level voltage;

in the threshold voltage programming design phase, the first scan signal and the third scan signal provide low level voltage, the second scan signal provides high level voltage;

in the driving light-emitting phase, the first scan signal and the third scan signal provide high level voltage, the second scan signal provides low level voltage.

2. The AMOLED pixel driver circuit as claimed in claim 1, wherein the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

3. The AMOLED pixel driver circuit as claimed in claim 1, wherein the first scan signal, the second scan signal and the third scan signal are all provided by an external timing controller.

4. The AMOLED pixel driver circuit as claimed in claim 1, wherein the predefined voltage is a constant voltage.

5. An active matrix organic light-emitting diode (AMOLED) pixel driving method, which comprises:

Step 1: providing an AMOLED pixel driver circuit, comprising:

a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground;

Step 2: entering a pre-charging phase:

the first scan signal providing high level voltage to cut off the fourth TFT; the second scan signal providing low level voltage to turn on the second TFT, the third TFT and the fifth TFT; the third scan signal providing high level voltage to turn on the sixth TFT; the power supply voltage being written into the drain and the top gate of the first TFT; the predefined voltage being written into the first node (i.e., the bottom gate of the first TFT); and the voltage provided by the data signal being written into the fourth node, the first capacitor being charged, with the voltage difference between the two ends being Vdata-Vpre, wherein Vdata is the voltage provided by the data signal and Vpre being the predefined voltage;

Step 3: entering a threshold voltage programming design phase:

the first scan signal remaining low level voltage to cut off the fourth TFT; the second scan signal remaining high level voltage to turn on the second TFT, the third TFT and the fifth TFT; the third scan signal providing low level voltage to cut off the sixth TFT; the first TFT being turned on, the voltages of the drain and the top gate of the first TFT continuously dropping as the time passing, and the threshold voltage of the first TFT continuously rising as the time passing, the threshold voltages of the first TFT stopping changing when the threshold voltage of the first TFT reaching Vth=Vpre-Vs, wherein Vth being the threshold voltage of the first TFT, Vs being the source voltage of the first TFT, at this point, the voltage of the top gate of the first TFT being stored in the second capacitor;

Step 4: entering a driving light-emitting phase:

the first scan signal providing high level voltage to turn on the fourth TFT; the second scan signal providing low level voltage to cut off the second TFT, the third TFT and the fifth TFT; the third scan signal providing high level voltage to turn on the sixth TFT; the voltage of the top gate of the first TFT remaining unchanged due to the storage of the second capacitor, and the threshold voltage of the first TFT remaining Vth=Vpre-Vs; the predefined voltage being written into the fourth node; the voltage of the first node (i.e., the bottom gate of the first TFT) becoming 2Vpre-Vdata, the first TFT turned on, the OLED emitting light, and the current flowing through the OLED being independent of the threshold voltage of the first TFT.

6. The AMOLED pixel driving method as claimed in claim 5, wherein the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

7. The AMOLED pixel driving method as claimed in claim 5, wherein the first scan signal, the second scan signal and the third scan signal are all provided by an external timing controller.

8. The AMOLED pixel driving method as claimed in claim 5, wherein the predefined voltage is a constant voltage.

9. An active matrix organic light-emitting diode (AMOLED) pixel driver circuit, which comprises: a first thin film transistor (TFT), a second TFT, a third TFT, a fourth TFT, a fifth TFT, a sixth TFT, a first capacitor, a second capacitor and an organic light-emitting diode (OLED);

the first TFT being a double-gate TFT for driving the OLED, having the bottom gate connected to a first node and the top gate connected to a second node, the source connected to anode of the OLED and the drain connected to a third node;

the second TFT having the gate connected to a second scan signal, the source connected to a data signal, the drain connected to a fourth node;

the third TFT having the gate connected to the second scan signal, the source connected to a predefined voltage and the drain connected to the first node;

the fourth TFT having the gate connected to a first scan signal, the source connected to the predefined voltage and the drain connected to the fourth node;

the fifth TFT having the gate connected to the second scan signal, the source connected to the second node and the drain connected to the third node;

the sixth TFT having the gate connected to a third scan signal, the source connected to the power supply voltage and the drain connected to the third node;

the first capacitor having one end connected to the first node and the other end connected to the fourth node;

the second capacitor having one end connected to the second node and the other end connected to the ground;

the OLED having the anode connected to the source of the first TFT and the cathode connected to ground;

wherein the first TFT, the second TFT, the third TFT, the fourth TFT, the fifth TFT and the sixth TFT being all low temperature polysilicon (LTPS) TFTs, oxide semiconductor TFTs or amorphous silicon (a-Si) TFTs;

wherein the first scan signal, the second scan signal and the third scan signal being all provided by an external timing controller;

wherein the first scan signal, the second scan signal, and the third scan signal are combined to correspond to, in sequence, a pre-charging phase, a threshold voltage programming design phase and a driving light-emitting phase;

in the pre-charging phase, the first scan signal provides low level voltage, the second scan signal and the third scan signal provide high level voltage;

in the threshold voltage programming design phase, the first scan signal and the third scan signal provide low level voltage, the second scan signal provides high level voltage;

in the driving light-emitting phase, the first scan signal and the third scan signal provide high level voltage, the second scan signal provides low level voltage.

10. The AMOLED pixel driver circuit as claimed in claim 9, wherein the predefined voltage is a constant voltage.

* * * * *